US006931231B1

(12) United States Patent
Griffin

(10) Patent No.: US 6,931,231 B1
(45) Date of Patent: Aug. 16, 2005

(54) INFRARED GENERATOR FROM AUDIO SIGNAL SOURCE

(75) Inventor: Paul Griffin, Nashville, TN (US)

(73) Assignee: Griffin Technology, Inc., Nashville, TN (US)

( * ) Notice: Subject to any disclaimer, the term of this patent is extended or adjusted under 35 U.S.C. 154(b) by 451 days.

(21) Appl. No.: 10/195,049

(22) Filed: Jul. 12, 2002

(51) Int. Cl.[7] ..... H06M 1/00

(52) U.S. Cl. ..... 455/3.06; 455/41.2; 455/151.2; 340/825.24; 340/825.25

(58) Field of Search ..... 455/3.06, 151.2, 455/212, 221, 312, 39, 42, 41.2, 41.3, 68, 419–420

(56) References Cited

U.S. PATENT DOCUMENTS

| | | | | | |
|---|---|---|---|---|---|
| 3,341,708 | A | | 9/1967 | Bilderback | 250/199 |
| 3,534,351 | A | | 10/1970 | Harnden, Jr. et al. | 340/237 |
| 4,045,777 | A | | 8/1977 | Mierzwinski et al. | 340/168 |
| 4,371,814 | A | | 2/1983 | Hannas | 318/16 |
| 4,482,947 | A | | 11/1984 | Zato et al. | 364/138 |
| 4,769,643 | A | | 9/1988 | Sogame | 340/825.6 |
| 4,774,511 | A | | 9/1988 | Rumbolt et al. | 340/825.6 |
| 4,802,114 | A | | 1/1989 | Sogame | 364/900 |
| 4,850,040 | A | | 7/1989 | Teich et al. | 455/603 |
| 4,959,828 | A | * | 9/1990 | Austin | 398/103 |
| 5,255,313 | A | | 10/1993 | Darbee | 379/102 |
| 5,268,889 | A | | 12/1993 | Furukawa et al. | 369/47 |
| 5,596,648 | A | * | 1/1997 | Fast | 381/77 |
| 6,421,426 | B1 | * | 7/2002 | Lucey | 379/56.3 |
| 2002/0030871 | A1 | * | 3/2002 | Anderson et al. | 359/150 |
| 2003/0043051 | A1 | * | 3/2003 | Shiraishi | 340/825.25 |

* cited by examiner

*Primary Examiner*—CongVan Tran
(74) *Attorney, Agent, or Firm*—Waddey & Patterson, P.C.; Mark J. Patterson

(57) ABSTRACT

An apparatus and method for converting an audio signal output through a stereo headphone jack into an infrared remote control signal. The invention utilizes the audio output to generate positive and negative pulses for operating two infrared light emitting diodes placed in parallel with opposite polarities. This allows for multiple devices with audio output jacks to be utilized as remote control devices. This connection also allows for doubling of the audio output frequency to generate infrared signals at frequencies above the normal capabilities of the audio output.

20 Claims, 3 Drawing Sheets

Left to Ground

Right to Ground

Left to Right

Light Output 100
600
112
114

INFRARED GENERATOR FROM AUDIO SIGNAL SOURCE

BACKGROUND OF THE INVENTION

The present invention relates generally to the generation of infrared signals. More particularly, this invention pertains to the generation of infrared signals utilizing an audio signal driver.

Several United States Patents discuss the generation of infrared signals. These include: U.S. Pat. No. 5,268,889 entitled Display device for a compact disc player and a compact disc; U.S. Pat. No. 5,255,313 entitled Universal remote control system; U.S. Pat. No. 4,850,040 entitled Infrared remote control system for activating and deactivating one or more devices in a single enclosed space; U.S. Pat. No. 4,802,114 entitled Programmable remote control transmitter; U.S. Pat. No. 4,774,511 entitled Universal remote control unit; U.S. Pat. No. 4,769,643 entitled Transmitter driver for programmable remote control transmitter; U.S. Pat. No. 4,482,947 entitled Multi-function, multi-unit remote control system and method therefore; U.S. Pat. No. 4,371,814 entitled Infrared transmitter and control circuit; U.S. Pat. No. 4,045,777 entitled Remote control transmitter and receiver for use with a television receiver; U.S. Pat. No. 3,534,351 entitled Light coupled battery powered remote control apparatus; and U.S. Pat. No. 3,341,708 entitled Amplitude Modulated Laser Transmitter. Each of these references is hereby incorporated by reference.

In addition, a plethora of devices are known that produce a standard headphone output signal utilizing a stereo headphone jack. These devices include portable computers, handheld computers, midi players, mp3 players, tape players, CD players, radios, etc. . . . which will generally be referred to herein as existing audio signal generating devices.

These teachings fail to take advantage of the two channel audio output available from a wide variety of devices that may be used to generate an infrared control signal. What is needed, then, is an infrared generator that can generate an infrared signal from a multiple channel audio signal source.

SUMMARY OF THE INVENTION

The present invention teaches an apparatus and method for converting a multiple channel audio signal to an infrared signal. A multiple channel audio signal is an audio output typical of a stereo headphone jack that includes a ground reference with left and right channels as a first signal output and a second signal output. The present invention utilizes these signals with a first infrared generator connected from the first signal output to the second signal output so that the first infrared generator will convert a positive signal differential between the first and second outputs into an infrared signal. This gives a pulse for each positive differential. The invention then goes on to use a second infrared generator connected from the second signal output to the first signal output so that the second infrared generator will convert a negative signal differential between the first and second outputs into an infrared signal. This creates a second pulse from the waveform outputs. Thus, at least two pulses are created for each period of the signal. This allows for frequency doubling to create signals in the infrared control signal frequency range while utilizing the lower frequency capabilities of the audio output.

In the present embodiment, the present invention utilizes infrared light emitting diodes for the infrared generators and is connected to a standard female headphone output jack using a male stereo headphone jack that is adapted to fit the female output jack.

The infrared LEDs are housed in a housing encasing at least a portion of the infrared generators. The housing is constructed to define at least one opening that will allow the infrared signal to be transmitted from the infrared generators. In the present embodiment, this housing is constructed from two halves that are shown as a first case and a second case which are engaged to encase the infrared generators. The two parts of the case are held together by a a securing band wrapped around the first and second case.

The present invention also teaches a method of generating an infrared control signal from an audio output signal with first and second audio output signals. The method includes the action of converting a positive differential between the first and second audio output signals into a first infrared pulse, and converting a negative differential between the first and second audio output signals into a second infrared pulse. The pulses may then be utilized by combining the first and second infrared pulses to generate the infrared control signal.

A still further method is taught by the present invention for generating an infrared control signal. This method includes the actions of generating a first audio output signal, generating a second audio output signal, converting a positive differential between the first and second audio output signals into a first infrared pulse, and converting a negative differential between the first and second audio output signals into a second infrared pulse. These pulses may then be used by combining the first and second infrared pulses to generate the infrared control signal.

Each of these actions may include multiple sub actions such as the action of generating a first audio output signal including the actions of determining a first electrical audio signal for the first audio output signal; creating a first audio signal file with a first signal representation; and processing the audio signal file to generate a first electrical audio signal from the first signal representation for the first audio output signal.

The action of generating a second audio output signal may include the actions of determining a second electrical audio signal for the second audio output signal, adding a second signal representation to the first audio signal file, and processing the audio signal file to generate a second electrical audio signal from the second signal representation for the second audio output signal. In addition, the action of generating a first audio output signal may include storing the audio signal file.

Furthermore, the action of generating a first audio output signal may include reading an audio signal file, and processing the audio signal file to generate an electrical audio signal for the first audio output signal.

The action of generating the first audio output signal can include the action of generating a pulse at one-half of a desired infrared signal frequency as a first electrical audio signal waveform, and the action of generating the second audio output signal can comprise generating an inverted magnitude pulse at one-half of the desired infrared signal frequency as a second electrical audio signal waveform.

Finally, the action of combining the first and second infrared pulses may include overlapping light paths of the first and second infrared pulses.

Thus, the present invention teaches the advantages and objectives of generating a multiple channel audio output signal and converting this signal to an infrared control signal for use as a remote control device.

DESCRIPTION OF THE PREFERRED EMBODIMENTS

Figure 1:
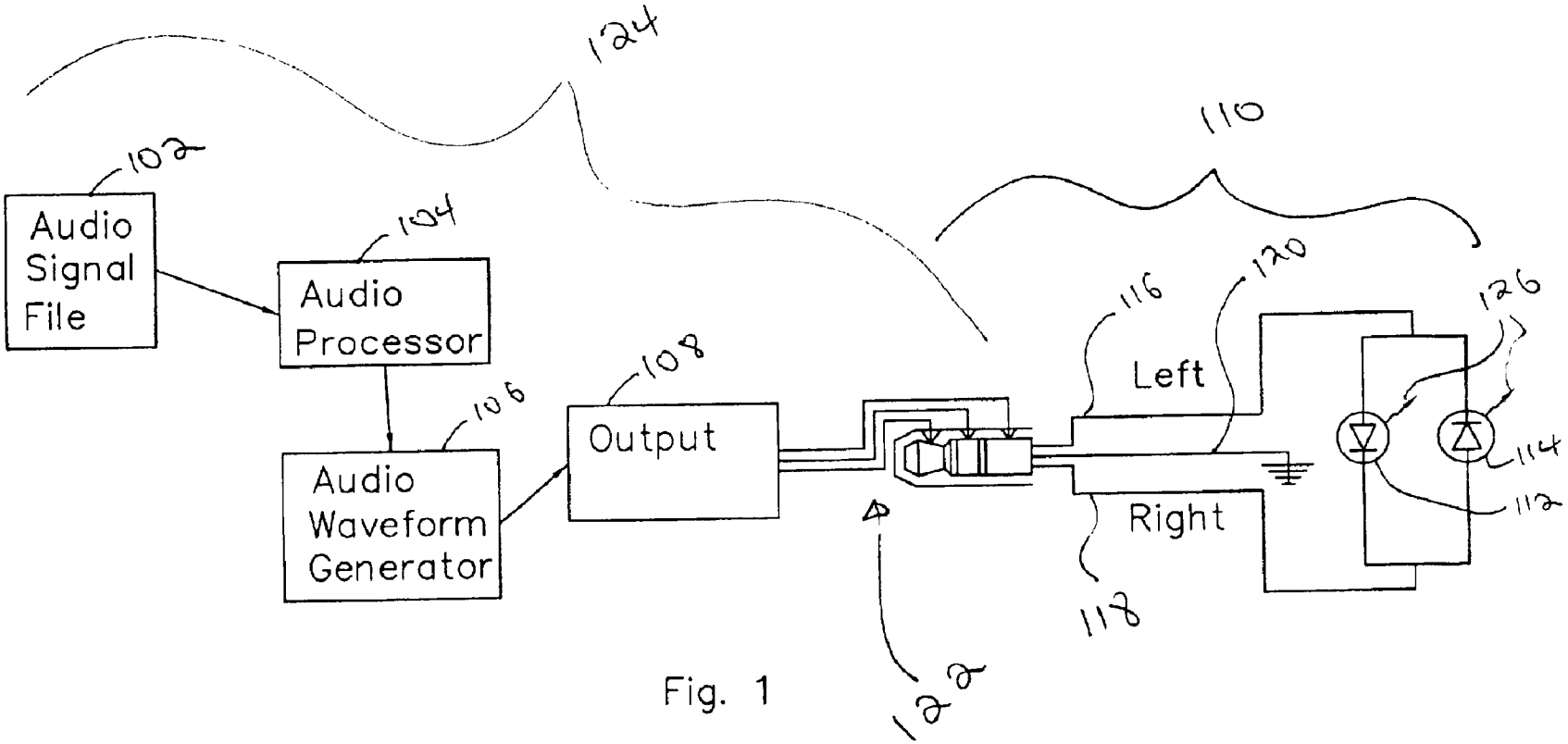
FIG. 1 is a schematic overview of an audio signal generation system and infrared converter.

FIG. 1 is a schematic overview of an audio to infrared converter 100 including a signal generation system 124 and infrared converter 110. The signal generation system 124 can create a multiple channel audio signal 122 in any of the well known manners of the prior art. Typical frequency ranges for these prior art audio devices are in the 20 Hz to 20,000 Hz range. The present invention uses this low frequency capability to generate the high frequency infrared output signal 126 such as that typically utilized in the 37,500 Hz range.

The preferred embodiment generates the audio signal 122. An audio signal file 102 is read from a storage medium such as a computer hard drive or RAM by an audio signal processor 104. The processor 104 instructs the waveform generator 106 to create a first signal output 116 and a second signal output 118 for the left and right channels of the output 108. The output is a male stereo headphone jack that is adapted to fit a female headphone input jack. The output 108 connects the multiple channel audio signal 122 to the infrared converter 110. The multiple channel audio signal 122 needs to at least include a left channel output 116 and a right channel output 118 and may also include a ground reference signal 120. The novelty of this approach is the development of the left and right channel outputs as utilized to control the frequency of the infrared output 126. This may be understood by looking at the infrared converter 110.

The infrared converter 110 includes a first infrared generator 112 connected to the first signal output 116 and the second signal output 118. The first infrared generator 116 is an infrared light emitting diode (LED) that is adapted to convert a positive signal on the first signal output 116 into an infrared signal 126. The infrared converter 110 also includes a second infrared generator 114 connected to the first signal output 116 and the second signal output 118. The second infrared generator is also an infrared LED that is adapted to convert a positive signal on the second output 118 into an infrared signal 126. In this manner, the infrared converter is connected to the first channel output 116 and second channel output 118 to monitor the signal differential between these outputs 116, 118. Thus, the infrared generator 110 is adapted to convert either a positive or negative voltage differential to an infrared signal 126. This may best be understood by referencing an example of the multiple channel audio signal 122 as shown in FIGS. 2 through 5.

Figure 2:
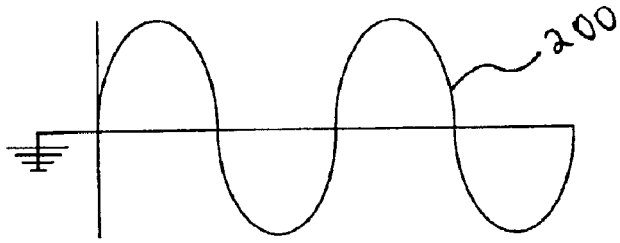
FIG. 2 is a signal representation of a left channel waveform.
Figure 3:
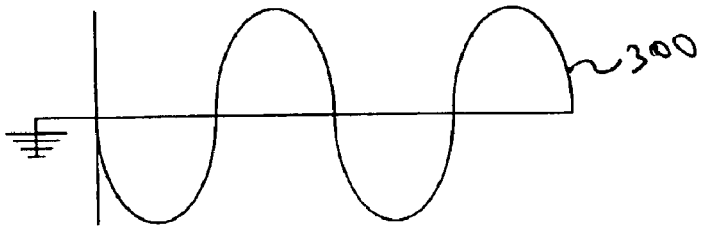
FIG. 3 is a signal representation of a right channel waveform.
Figure 4:
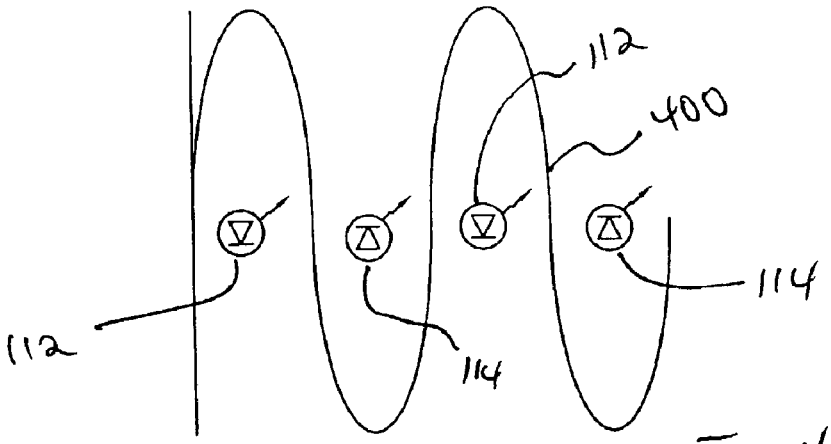
FIG. 4 is a signal representation of the difference between the left and right channels using one of the channels as a reference.
Figure 5:
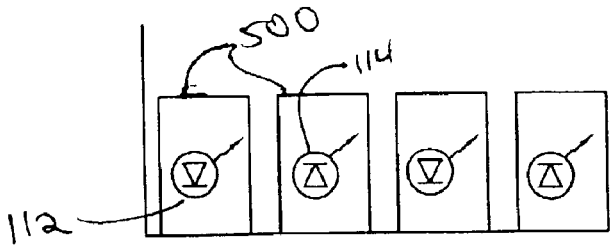
FIG. 5 is a charted representation of the light pulse output from the converted audio signal.
Figures 6, 7, 8, 9, 10, 11, 12, 13:
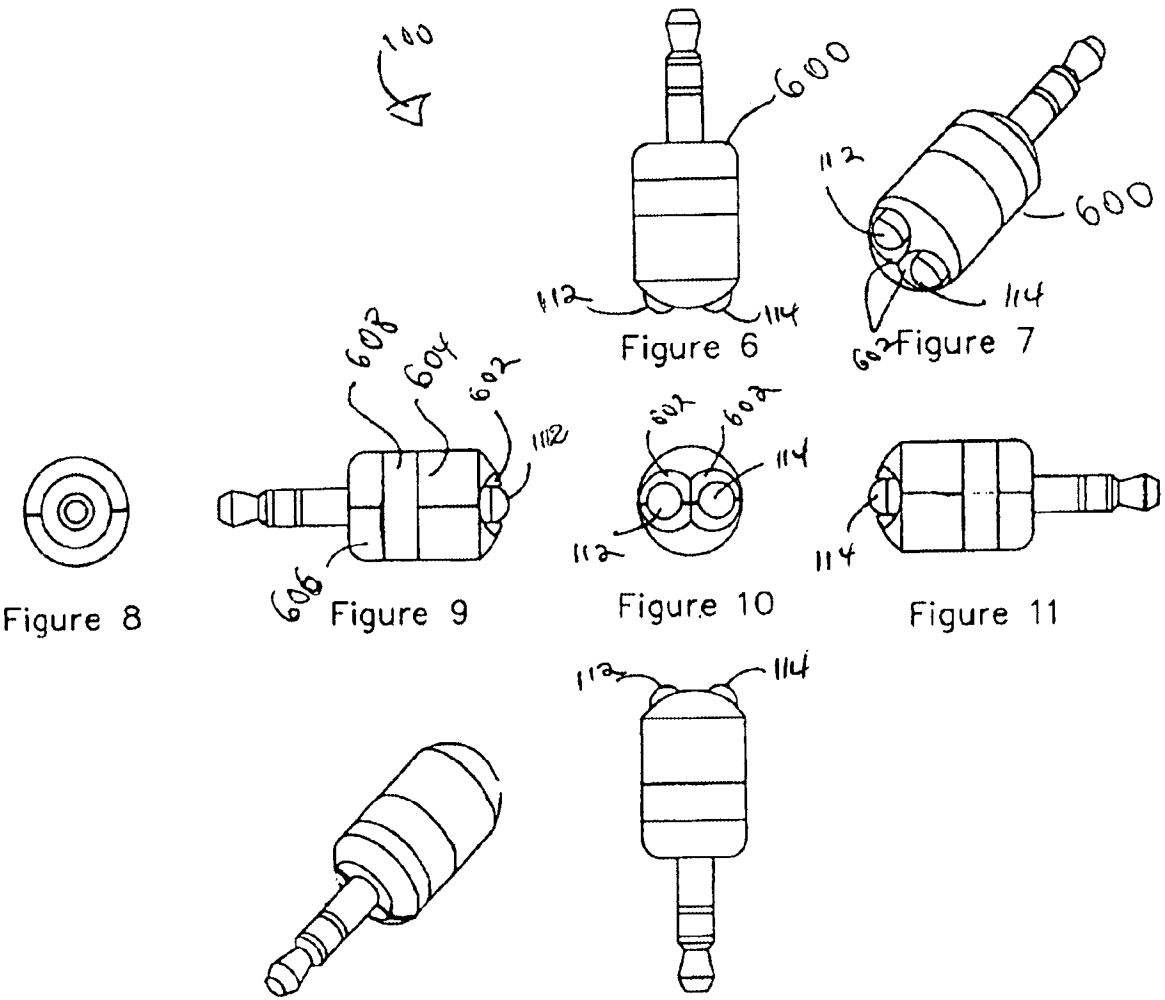
FIG. 6 is a top elevation of the audio infrared generator of Applicant's invention.
FIG. 7 is a front perspective view showing the audio infrared generator of Applicant's invention.
FIG. 8 is a back elevation of the audio infrared generator of Applicant's invention.
FIG. 9 is a left side elevation of the audio infrared generator of Applicant's invention, both sides being identical.
FIG. 10 is a front elevation of the audio infrared generator of Applicant's invention.
FIG. 11 is a right side elevation of the audio infrared generator of Applicant's invention, both sides of the case being identical.
FIG. 12 is a bottom perspective view of the audio infrared generator of Applicant's invention.
FIG. 13 is a bottom elevation of the audio infrared generator of Applicant's invention.

FIG. 2 shows a signal representation of a left channel waveform 200 and FIG. 3 shows a signal representation of a right channel waveform 300. if the right channel is used as a reference point, the signal differential between the left and right channels may be seen as shown in FIG. 4. The connection from the left to right channel provides an increased voltage by utilizing both the positive and negative aspects of the audio output signal, as well as providing a floating output. As shown in FIG. 4, by connecting the first LED to pulse on the positive aspect of the signal-to-signal differential, one pulse is achieved for each cycle of the signal differential. Similarly, by connecting the second LED to pulse on the negative aspect of the signal-to-signal differential, an additional pulse is achieved for each cycle of the signal differential. In this manner, two pulses are achieved for each cycle of the signal differential. This results in the pulse output as shown by FIG. 5. Each light output pulse 500 is shown associated with either the first 112 or second 114 LED converter.

FIGS. 6 through 13 show various angles of the design of the audio infrared generator 100. The infrared LEDs 112, 114 are housed in a housing 600 encasing at least a portion of the infrared generators 112, 114. The housing 600 is constructed to define at least one opening 602 that will allow the infrared signal to be transmitted from the infrared generators 112, 114. In the design shown, two openings 602 are provided with one opening 602 for each infrared generator 112, 114. In the present embodiment, this housing 600 is constructed from two halves 604, 606 that are shown as a first case 604 and a second case 606 which are engaged to encase the infrared generators 112, 114. The two parts of the case are held together by a securing band 608 wrapped around the first and second case 602, 604. The securing band 608 is a colored adhesive backed band that sticks upon itself and the first and second cases 602, 604.

Through the apparatus and waveforms of the figures, one can see that the present invention also teaches a method of generating an infrared control signal from an audio output signal. The audio output signal includes both first and second audio output signals. The method includes the action of converting a positive differential between the first and second audio output signals into a first infrared pulse, and then converting a negative differential between the first and second audio output signals into a second infrared pulse. The infrared control signal may then be created by combining the first and second infrared pulses to generate the infrared control signal.

Each of these actions may include multiple sub actions. For example, the action of generating a first audio output signal may include the actions of determining a first electrical audio signal that is needed for the first audio output signal. This may be done for existing remote control devices by measuring the existing signals and determining the pattern, pulses, duration and other characteristics for that signal. The process may then continue by creating a first audio signal file with a first signal representation that will generate the first electrical audio signal when the file is played. Finally, the method continues by reading and processing the audio signal file to generate a first electrical audio signal from the first signal representation for the first audio output signal. In this manner, we have created the necessary electrical audio signal that may be used for the conversion process. The action of generating a second audio output signal may also include the actions of determining a second electrical audio signal for the second audio output signal, adding a second signal representation to the first audio signal file, and processing the audio signal file to generate a second electrical audio signal from the second signal representation for the second audio output signal. This allows for both signals to be created from a common audio file. In addition, the action of generating a first audio output signal may include storing the audio signal file so that the file can be used at a later time.

The action of generating the first audio output signal can include the action of generating a pulse at one-half of a desired infrared signal frequency as a first electrical audio signal waveform, and the action of generating the second audio output signal can comprise generating an inverted magnitude pulse at one-half of the desired infrared signal frequency as a second electrical audio signal waveform.

Finally, the action of combining the first and second infrared pulses may include overlapping light paths of the first and second infrared pulses such that the signals become mixed to form the output infrared signal.

Thus, although there have been described particular embodiments of the present invention of a new and useful Infrared Generator from Audio Signal Source, it is not intended that such references be construed as limitations upon the scope of this invention except as set forth in the following claims.

What is claimed is:

1. An apparatus for converting a multiple channel audio signal to an infrared signal, the multiple channel audio signal including both a first signal output and a second signal output, the apparatus comprising:

a first infrared generator connected to the first signal output and adapted to convert a positive signal on the first signal output into an infrared signal;

a second infrared generator connected to the second signal output and adapted to convert a positive signal on the second output into an infrared signal.

2. The apparatus of claim 1, the first infrared generator comprising an infrared light emitting diode.

3. The apparatus of claim 1, the second infrared generator comprising an infrared light emitting diode.

4. The apparatus of claim 1, the first and second infrared generators comprising infrared light emitting diodes.

5. The apparatus of claim 1, the input jack comprising:

a male stereo headphone jack adapted to fit a female headphone output jack.

6. The apparatus of claim 1, further comprising:

a housing encasing at least a portion of the infrared generators, the housing defining at least one opening adapted to allow the infrared signal to be transmitted from the infrared generators.

7. The apparatus of claim 6, the housing comprising:

a first case; and a second case, the first and second case adapted to be engaged to encase at least a portion of the infrared generators, the housing defining at least one opening adapted to allow the infrared signal to be transmitted from the infrared generators.

8. The apparatus of claim 6, the housing further comprising:

a securing band adapted to secure the first and second case together.

9. An apparatus for converting an audio output to an infrared signal, the audio output including a first and second signal available through an output jack, the apparatus comprising:

a mating input jack adapted to couple with the output jack to receive the first signal and the second signal from the audio output;

a first infrared generator electrically connected to the mating input jack from the first signal to the second signal, the first infrared generator adapted to convert a positive signal differential between the first and second outputs into an infrared signal; and a second infrared generator electrically connected to the mating input jack from the second signal to the first signal, the second infrared generator adapted to convert a negative signal differential between the first and second outputs into an infrared signal.

10. The apparatus of claim 9, the first infrared generator comprising an infrared light emitting diode.

11. The apparatus of claim 9, the second infrared generator comprising an infrared light emitting diode.

12. The apparatus of claim 9, the first and second infrared generators comprising an infrared light emitting diodes.

13. A method of generating an infrared control signal from an audio output signal including a first audio output signal and a second audio output signal, the method comprising:

converting a positive differential between the first and second audio output signals into a first infrared pulse;

converting a negative differential between the first and second audio output signals into a second infrared pulse; and combining the first and second infrared pulses to generate the infrared control signal.

14. A method of generating an infrared control signal, the method comprising:

generating a first audio output signal;

generating a second audio output signal;

converting a positive differential between the first and second audio output signals into a first infrared pulse;

converting a negative differential between the first and second audio output signals into a second infrared pulse; and combining the first and second infrared pulses to generate the infrared control signal.

15. The method of claim 14, generating a first audio output signal comprising:

determining a first electrical audio signal for the first audio output signal;

creating a first audio signal file with a first signal representation; and processing the audio signal file to generate a first electrical audio signal from the first signal representation for the first audio output signal.

16. The method of claim 15, generating a second audio output signal comprising determining a second electrical audio signal for the second audio output signal;

adding a second signal representation to the first audio signal file; and processing the audio signal file to generate a second electrical audio signal from the second signal representation for the second audio output signal.

17. The method of claim 15, generating a first audio output signal further comprising:

storing the audio signal file.

18. The method of claim 14, generating a first audio output signal comprising:

reading an audio signal file; and processing the audio signal file to generate an electrical audio signal for the first audio output signal.

19. The method of claim 14, wherein generating the first audio output signal comprises generating a pulse at one-half of a desired infrared signal frequency as a first electrical audio signal waveform; and generating the second audio output signal comprises generating an inverted magnitude pulse at one-half of the desired infrared signal frequency as a second electrical audio signal waveform.

20. The method of claim 14, wherein combining the first and second infrared pulses comprises:

overlapping light paths of the first and second infrared pulses.

* * * * *